US005775534A

United States Patent [19]

Webb et al.

[11] Patent Number: 5,775,534

[45] Date of Patent: Jul. 7, 1998

[54] BEVERAGE CONTAINER HAVING FILTERED OPENING

[76] Inventors: Michael Reginald Webb, Theydon Willows, Copice Row, Theydon Bois, Essex CM16 7DP; Denis Matthews, Laurel House, Earlstone Common, Burghclere, Nr. Newbury, RG20 9HN, both of United Kingdom

[21] Appl. No.: 601,341

[22] Filed: Feb. 16, 1996

[30] Foreign Application Priority Data

| | | | |
|---|---|---|---|
| Nov. 24, 1995 | [GB] | United Kingdom | 9524099 |
| Jan. 12, 1996 | [GB] | United Kingdom | 9600640 |
| Feb. 5, 1996 | [GB] | United Kingdom | 9602263 |

[51] Int. Cl.[6] ..... B65D 17/34

[52] U.S. Cl. ..... 220/269; 220/266; 220/270; 220/360; 220/372; 220/730; 220/906; 222/1; 222/189.07

[58] Field of Search ..... 222/189.07, 547, 222/1; 220/522, 906, 254, 269, 270, 265, 266, 272, 273, 360, 367.1, 368–372, 374, 607, 703, 719, 730; 215/307, 308, 310, 386, 387

[56] References Cited

U.S. PATENT DOCUMENTS

| | | | |
|---|---|---|---|
| 4,537,325 | 8/1985 | Morehead . | |
| 4,901,877 | 2/1990 | Hall . | |
| 5,056,681 | 10/1991 | Howes | 220/522 |
| 5,125,525 | 6/1992 | Tucker | 220/254 |
| 5,316,166 | 5/1994 | Pavely et al. | 220/269 |
| 5,379,914 | 1/1995 | Martins | 220/906 X |
| 5,388,718 | 2/1995 | Lo | 220/522 |

FOREIGN PATENT DOCUMENTS

| | | | |
|---|---|---|---|
| 47903 | 3/1979 | Germany | 222/189.07 |
| 87 16 838 | 3/1988 | Germany | B65D 17/34 |
| 90 04 706 | 8/1990 | Germany | B65D 17/00 |
| 91 02 413 | 6/1991 | Germany | B65D 17/50 |
| 49202 | 2/1992 | Japan | 220/906 |
| 42503 | 3/1925 | United Kingdom | 222/189.07 |
| WO 93/08087 | 4/1993 | WIPO | B65D 17/32 |

*Primary Examiner*—Allan N. Shoap
*Assistant Examiner*—Robin A. Hylton

[57] ABSTRACT

A beverage container in the form of an aluminium can has a top plate in which a dispensing aperture is formed by pulling a tab so as to inwardly displace a tongue portion. A filtering means is resiliently mounted within the container so as to be deployed at a location traversing the dispensing aperture after the tongue portion has been inwardly displaced. The filtering means may be a perforate plate and may have perforations defining a competition visual indication whereby the token becomes visible only after the container is opened.

26 Claims, 9 Drawing Sheets

FIG. 21
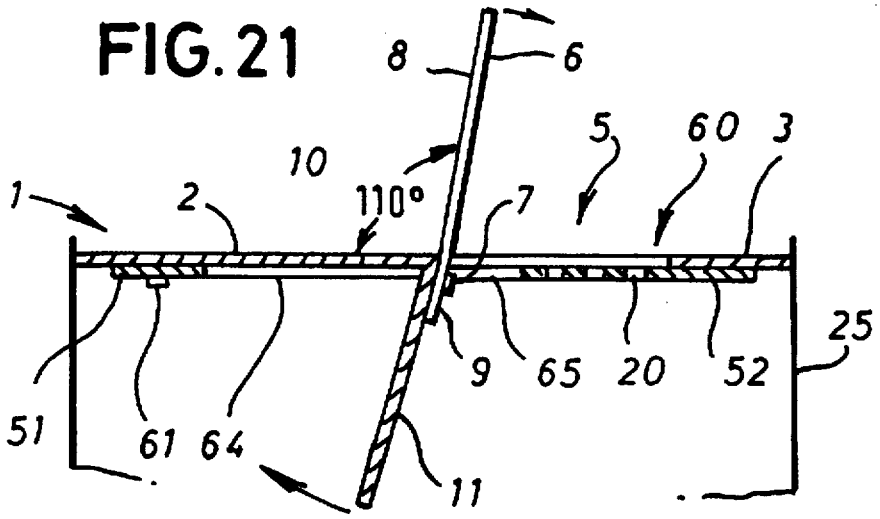
FIG. 22
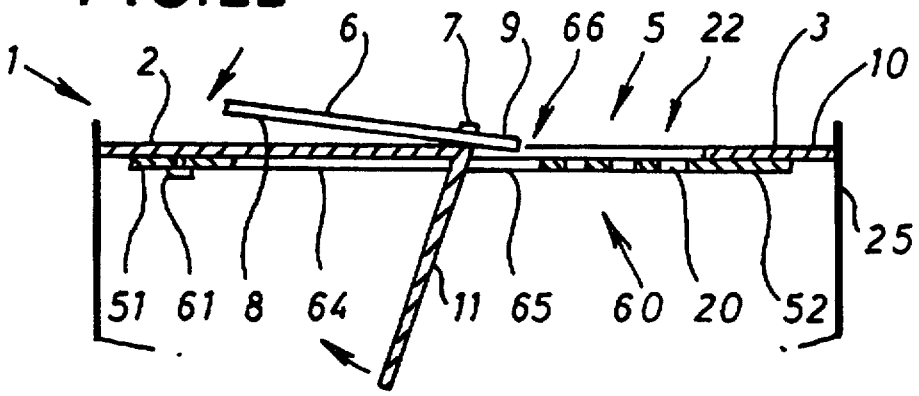
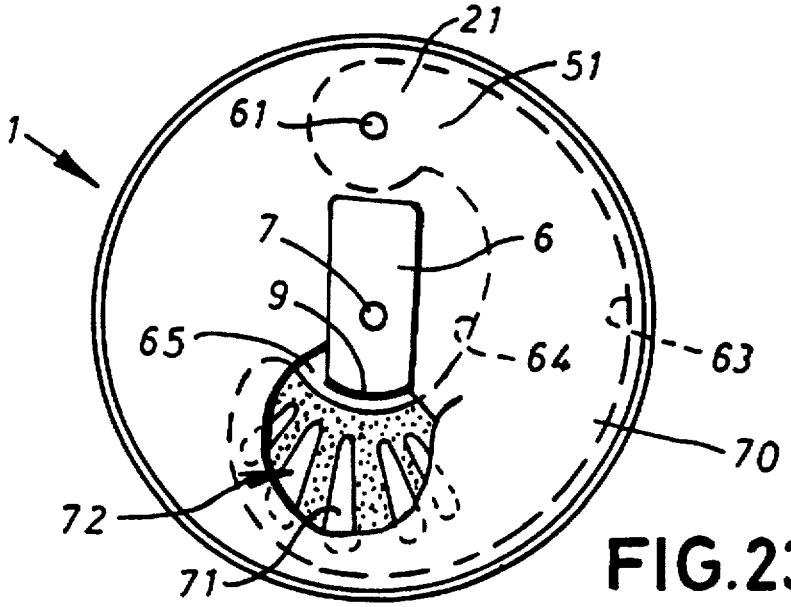
FIG. 23

BEVERAGE CONTAINER HAVING FILTERED OPENING

BACKGROUND AND FIELD OF THE INVENTION

This invention relates to a container and in particular but not exclusively to a beverage container in the form of a can.

It is known to provide a top for such containers comprising a plate of thin aluminium sheet material in which a tear line is pre-formed, thereby allowing a dispensing aperture to be formed using a manually operable actuating means mounted on the plate such as a ring pull tab. It is also known for such dispensing apertures to be formed by displacing a tongue portion defined by the tear line so as to be bent inwardly of the container.

A problem with such containers is that insects or other debris may enter the dispensing aperture and may subsequently be dispensed. This is particularly a problem with soft drinks which are consumed directly from the container by placing the top to the user's lips and without first decanting the contents into a receptacle.

It is known from WO93/08087 to provide a filter mounted on the external surface of the top of the container and moveable into a position in which it overlays the dispensing aperture to prevent the ingress of insects. A disadvantage of this arrangement is that the filter is exposed during handling of the container and is therefore susceptible to contamination and the accumulation of debris and is also susceptible to damage.

It is also known from U.S. Pat. No. 5,379,914 to provide a filtering device for a container, the filtering device comprising a concave net filter in the shape of one half of an egg which is placed underneath the dispensing aperture. A disadvantage of this device is that the filter defines a finite volume within the net into which debris or insects may enter so that it is still possible for such insects and debris to pose a hazard. It is also not possible to insert a drinking straw into the container beyond the depth of the net filter.

It is an object of the present invention to provide a container having an improved filtering means for excluding insects and other contaminants from entering a dispensing aperture.

It is a further object to provide a container having a top plate with a disruptable zone in which a dispensing aperture is formed in use by inwardly deflecting a tongue portion and to provide a filtering means which is not susceptible to contamination during handling and which can be deployed to traverse the dispensing aperture.

It is a further object of the present invention to provide a filtering means which will yield to allow the insertion of a drinking straw in a beverage container.

It is a further object of the present invention to provide a token for a competition which is concealed within a beverage container and which is visible when the container is opened.

SUMMARY OF THE INVENTION

According to the present invention there is disclosed a container having a top comprising a plate which is disruptable at a zone of weakness constituted by a tear line defining in outline a tongue portion, the top further comprising actuating means mounted on an outer face of the plate and operable to cause tearing of the plate along the tear line and to displace the tongue portion relative to the plate to define a dispensing aperture; and filtering means mounted internally of the container and comprising a filter and operable to support the filter at a deployed position adjacent or in contact with the plate at a location traversing the dispensing aperture.

The filter thereby acts to prevent the ingress of insects or debris via the aperture and also acts to prevent the egress of foreign bodies which may have entered the container during filling. By mounting the filter within the container, contamination and damage of the filter is avoided during handling and distribution of the container. Deployment of the filter at a location traversing the dispensing aperture avoids the formation of a recess beneath the aperture into which debris or insects may enter.

Preferably the actuating means is operable to inwardly displace the tongue portion relative to the container and the filtering means is operable to support the filter in an initial position in which it overlays an inner face of the tongue portion prior to actuation of the actuating means, the filter being displaceable to an intermediate position at which it is spaced from an inner face of the plate to accommodate inward movement of the tongue portion and being displaceable thereafter to the deployed position.

Displacement of the filter to the intermediate position and subsequently to the deployed position enables a filter to be provided sufficiently close to the plate to completely traverse the dispensing aperture, notwithstanding the need for the tongue portion to extend into the container.

Preferably the filtering means comprises a mounting portion fixedly mounted to the plate and supporting the filter so as to be deflectable relative to the mounting portion, and biasing means operable to bias the filter into contact with the plate in the deployed position.

By securing the filtering means to the plate, the filtering means and the plate thereby form a subassembly which can be handled as a single unit when assembling the container. The subassembly will then be presented to a body of the container and the plate peripherally sealed to the body in a conventional manner after filling the body with the liquid contents to be dispensed. Since the filter is biased into contact with the plate in the deployed position, it remains possible to deflect the filter for example by the insertion of a straw in order to directly gain access to the interior of the container. It is therefore possible to utilize a drinking straw to dispense the contents of the container. Upon withdrawal of the drinking straw, the biasing means will be operable to return the filter into the deployed position, thereby maintaining the filtering function of the filter.

Advantageously the mounting portion and the filter are constituted by a resilient filter member of unitary construction having a shape memory tending to bias the filter into contact with the inner face of the plate.

This arrangement has the advantage of avoiding the need for a separate spring member to bias the filter.

Conveniently the mounting portion is adhesively mounted to the inner face of the plate.

The filtering means may alternatively have a mounting portion which is mounted to the plate by means of co-operating connecting formations.

Conveniently such connecting formations comprise a projection formed integrally with the plate and received in a connecting aperture defined in the mounting portion.

Such a projection may for example be a rivet formed unitarily with the top plate of the container.

The filter and the mounting plate when so connected may be formed of the same material as the plate.

The filtering means may comprise an elongate strip in sheet form having a first flat portion constituting the mounting portion, a perforate second flat portion constituting the filter and an intermediate portion intermediate the first and second flat portions having a shape memory, the intermediate portion thereby constituting the biasing means.

The intermediate portion may comprise a bowed portion which overlays the mounting portion in spaced relationship thereto and defines an access aperture facilitating access to the mounting portion during assembly.

Alternatively the intermediate portion may be constituted by a third flat portion of the elongate strip which in the deployed position is co-planar with the first and second flat portions. Such an elongate strip may then be of arcuate profile when viewed in projection orthogonally to the first flat portion so as to define a cut out accommodating inward movement of the actuating means relative to the plate.

An advantage of such an arcuate strip is to achieve greater length of the intermediate portion in order to minimise the acuteness with which the intermediate portion needs to be bent when flexing to accommodate inward motion of the tongue portion. This is particularly important when it is desirable to use materials such as aluminium which exhibit less resilience to bending than conventional spring materials such as steel.

In a preferred embodiment the filter comprises an array of apertures with a size in the range 2 to 5 mm.

The filter may comprise a sieve formed as a grid in which a first set of mutually parallel linear members is intersected by a second set of mutually parallel members and wherein the second hinge line is substantially parallel to the first members.

According to a further aspect of the present invention there is disclosed a subassembly comprising a top and a filtering means as above defined.

The filter may comprise visual indication means which are visible via the dispensing aperture in the deployed position but which remain concealed until the point at which the container is opened. The visible indicating means may thereby comprise a token for use in a competition or game in which an individual container is to be identified or distinguished from other containers by means of the visual indication in order to indicate that the purchaser has won the competition or game.

The visual indication means may be constituted by the disposition or shape of perforations provided in the filter or alternatively by any other suitable visible marking, surface finish or pictorial representation.

According to a further a spec t of the present invention there is disclosed a method of dispensing liquid from a container comprising the steps of;

operating an actuating means to disrupt a plate forming a top of a container by tearing of the plate along a pre-formed tear line and displacing a tongue portion defined in outline by the tear line to form a dispensing aperture;

deflecting a filter mounted in an initial position adjacent an inner face of the plate to an intermediate position at which it is spaced from the inner face by displacement of the tongue portion;

further displacing the tongue portion to a position in which the filter is free to relax to a deployed position in which it extends in contact with or in proximity to the inner face of the plate to thereby traverse the dispensing aperture, and dispensing liquid via the dispensing aperture through the filter.

Optionally, the method may include the step of arresting movement of the actuating means at a location such that the filter is held in the intermediate position so as to be held clear of the inner face by the tongue portion, liquid then being dispensed via the dispensing aperture in a manner which allows the filter to be bypassed.

This optional aspect of the method may be useful when it is desired to dispense liquid into a receptacle prior to consumption, as opposed to drinking the liquid directly from the container, since the presence of the filter in the deployed position may in general slow the rate at which liquid flows through the dispensing aperture.

According to a further aspect of the present invention there is disclosed a method of assembling a container as hereinbefore disclosed and comprising the steps of mounting the filtering means onto the inner face of the plate and subsequently joining the plate to the body of the container.

According to a further aspect of the present invention there is disclosed a method of dispensing liquid from a container comprising the steps of;

operating an actuating means to disrupt a plate forming a top of a container by tearing of the plate along a pre-formed tear line and displacing a tongue portion defined in outline by the tear line to form a dispensing aperture;

deflecting a visual indication means mounted in an initial position adjacent an inner face of the plate to an intermediate position at which it is spaced from the inner face by displacement of the tongue portion;

further displacing the tongue portion to a position in which the visible indicating means is free to relax to a deployed position in which it extends in contact with or in proximity to the inner face of the plate to thereby traverse the dispensing aperture, thereby revealing the visual indication means so as to be visible via the dispensing aperture; and dispensing liquid via the dispensing aperture.

BRIEF DESCRIPTION OF THE DRAWINGS

A preferred embodiment of the present invention will now be described by way of example only and with reference to the accompanying drawings of which;

FIGS. 19 to 22 are schematic partly sectioned side elevations of the container of FIGS. 16 to 18 showing progressively different stages of opening; and FIG. 23 is a plan view of a container having a further alternative filtering means.

DETAILED DESCRIPTION

Figure 1:
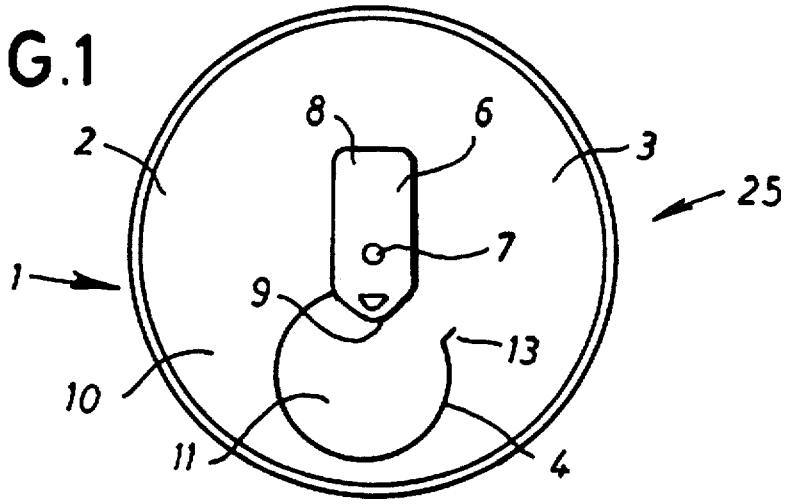
FIG. 1 is a plan view of a top of a container in accordance with the present invention prior to use.

In FIG. 1 a container 1 consists of an aluminium can for dispensing a carbonated soft drink. The container 1 has a top 2 comprising a plate 3 of aluminium sheet material which is peripherally crimped to a cylindrical body 25 of the container.

Figure 2:
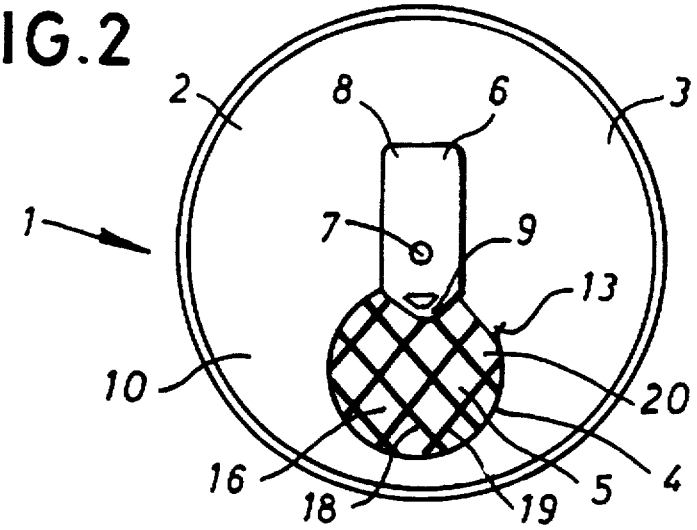
FIG. 2 is a plan view of the top of FIG. 1 after opening the dispensing aperture.

The plate 3 is pre-formed with a tear line in the form of a groove 4 which creates a zone of weakness along which tearing of the plate 3 will result in the formation of a dispensing aperture 5 as shown in FIG. 2.

The top 2 is opened by means of an actuating tab 6 which is secured to the plate 3 by means of a rivet formation 7 formed integrally with the plate. The tab 6 is also formed of aluminium but is formed with sufficient rigidity to act as a lever during the opening operation.

The tab 6 has at one end a handle portion 8 and at its other end a tapered nose 9, the rivet formation 7 acting as a fulcrum intermediate the handle portion and the nose such that by pulling upwardly on the handle portion a user causes the nose to be depressed towards an upper surface 10 of the plate 3.

Figure 3:
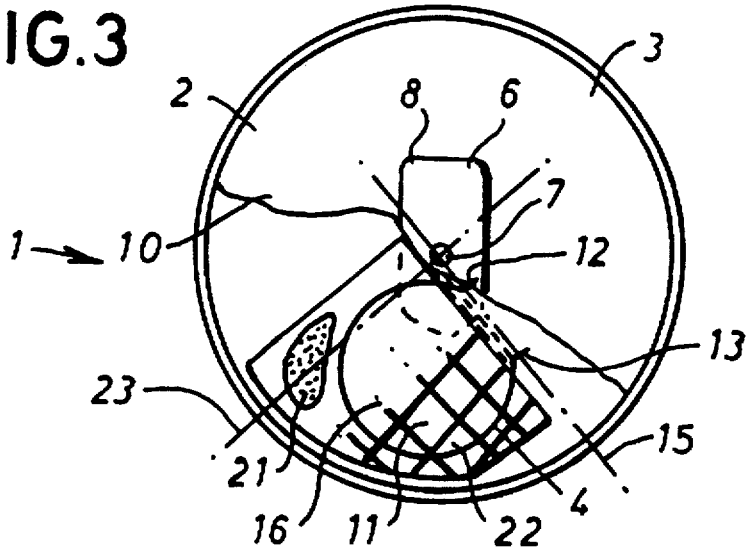
FIG. 3 is a schematic plan view, partly sectioned, to reveal the location of the filter prior to opening.

The groove 4 is partly circular in shape to define in outline a tongue portion 11 of the plate 3, the groove having end portions 1 2 and 13 which define therebetween a hinge portion of the tongue portion which remains intact subsequent to the tearing operation and defines a first bend line 15 shown in FIG. 3 about which the tongue portion 11 effectively pivots.

A filter member 16 is mounted on an inner face 17 of the plate 3. The filter member 16 consists of a filter 22 of plastics material in the form of a rectilinear grid in which a parallel array of first linear members 18 intersects a parallel array of second linear members 19 to define an array of square filter apertures 20 therebetween. The size of the filter apertures 20 is 3 $mm^2$.

As shown in FIG. 3, the filter 22 extends over an area of the inner face 17 which includes the tongue portion 11, the filter 22 being supported by a mounting portion 21 which is adhesively secured to the inner face 17 such that the filter 22 is supported in proximity or in contact with the inner face 17 by virtue of the shape memory of the plastics material forming the filter member 16.

The mounting portion 21 is adhesively secured to the inner face 17 at a location lying approximately on a datum line 23 which extends at 90° to the first bend line 15 and intersects with the first bend line at the position of the rivet formation 7.

The filter member 16 is oriented such that second linear members 19 are also aligned parallel to the datum line 23. The filter member 16 is more easily flexible about bend lines parallel to the linear members 18 or 19 so that the effect of this orientation is that the datum line 23 tends to act as a second hinge line when the filter 22 is inwardly depressed by action of the tongue portion 11.

Figure 4:
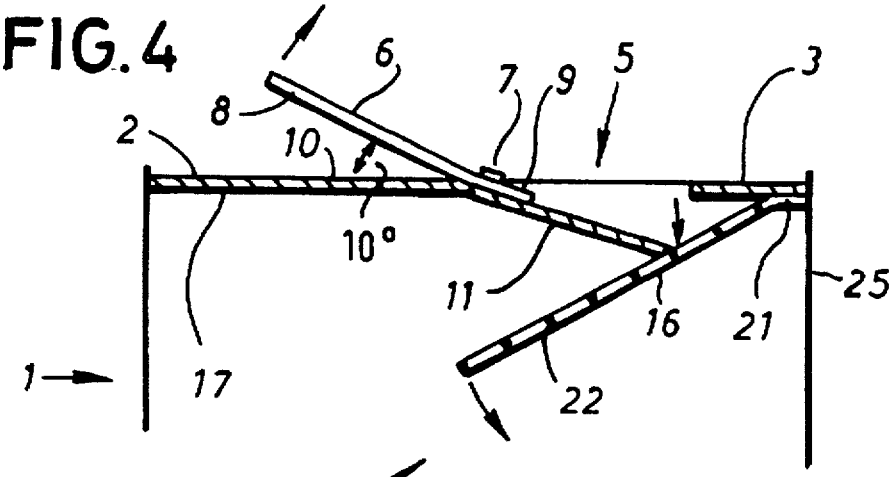
FIG. 4 is a schematic side elevation illustrating the relative positions of the tab, tongue and filter during an initial phase of opening.

As shown in FIG. 4, actuation of the tab 6 in order to open the container 1 is effected by raising the tab such that it pivots about the rivet formation 7 and forces downwardly the nose 9, thereby resulting in tearing of the plate 3, commencing at the end portion 13 of the groove 4. FIGS. 4 to 8 are highly schematic and do not reflect the fact that the tab, filter and tongue pivot about bend lines which are mutually inclined as seen from FIG. 3. The tongue 11 begins to become partially detached from the plate 3 and moves downwardly. A tear rapidly progresses around a tear line defined by the groove 4 and continued downward movement of the tongue portion 11 is accompanied by bending about the first bend line 15. Downward motion of the tongue 11 urges the filter 22 downwardly into an intermediate position shown in FIG. 5, this downward motion being accommodated by bending of the plastics material forming the filter member 16 while the mounting portion 21 remains adhesively secured to the inner face 17.

Figure 7:
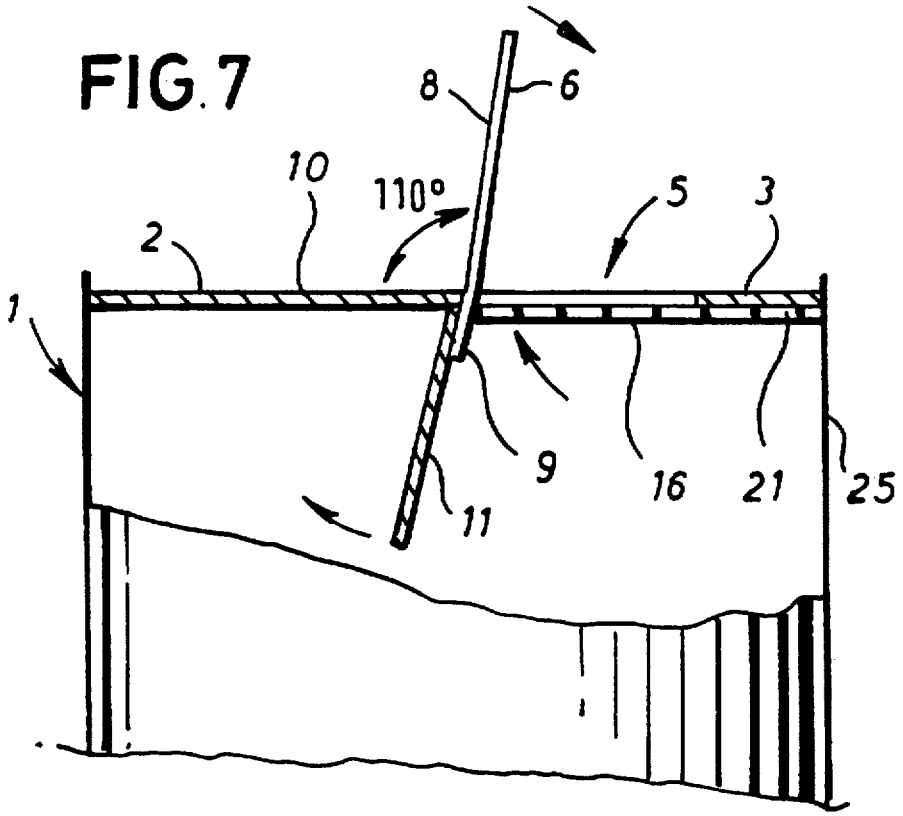
Figure 8:
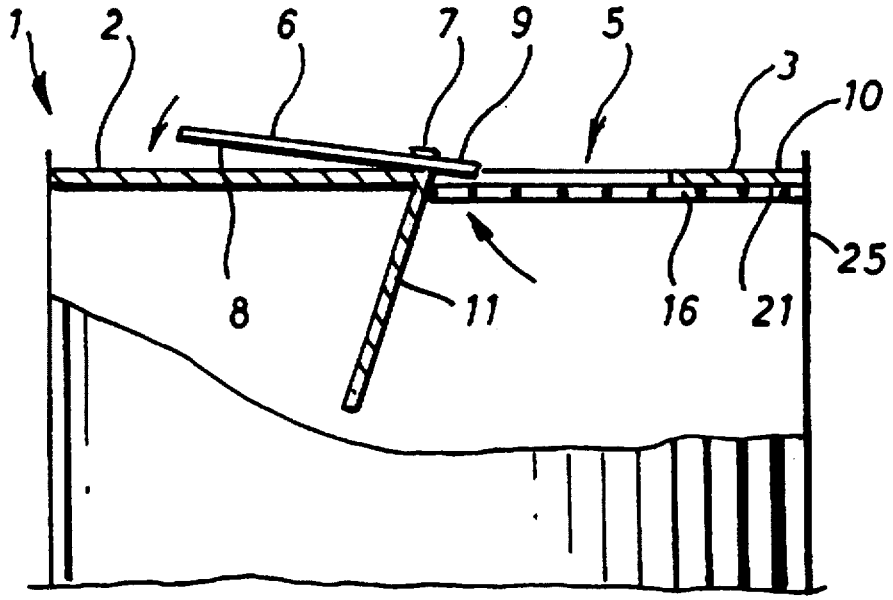

Continued pivotal motion of the tab 6 results in the tongue portion 11 being bent through more than 90° degrees to reach a position as shown in FIG. 7 in which the filter member 16 is able to relax to its initial position in which the filter 22 underlays the inner face 17 and traverses the dispensing aperture 5.

Finally, the tab 6 is returned to a position corresponding to its initial location by reverse bending the tab, the tongue portion 11 tending to remain in its deformed position leaving the dispensing aperture 5 unimpeded for the subsequent dispensing of the contents of the container 1.

During such dispensing, the filter 22 traverses the dispensing aperture and filters the contents as they are dispensed. The effect of the flow of liquid through the filter 22 also further urges the filter against the plate 3 thereby ensuring good contact with the inner face 17. After partly dispensing the contents of the container 1, the container may then stand for some time before further dispensing. During this time, the filter 22 prevents the ingress of foreign bodies into the container via the dispensing aperture 5 and in particular excludes insects such as wasps.

Figure 5:
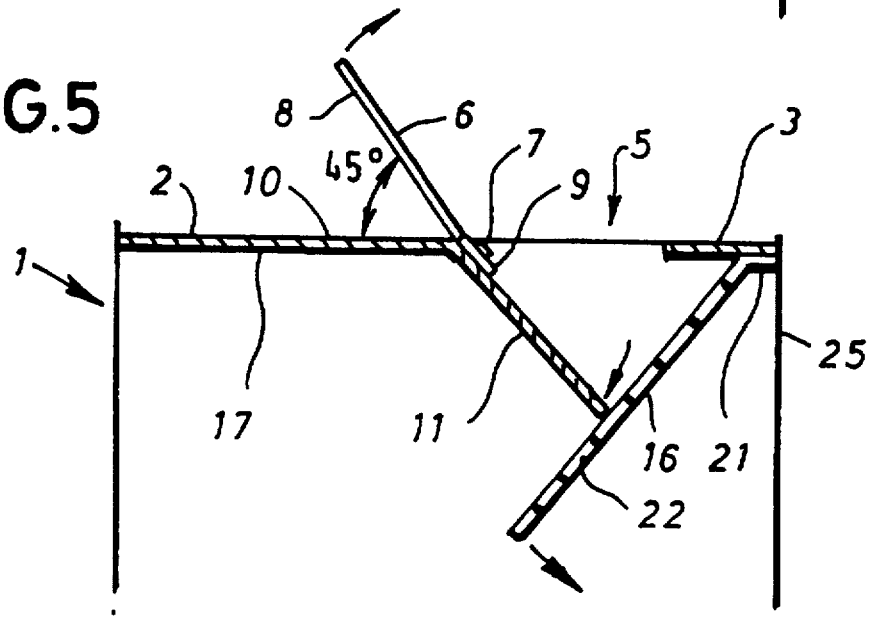
FIGS. 5 to 8 are schematic side elevations showing the relative positions of the components of FIG. 4 at subsequent stages of opening.
Figure 6:
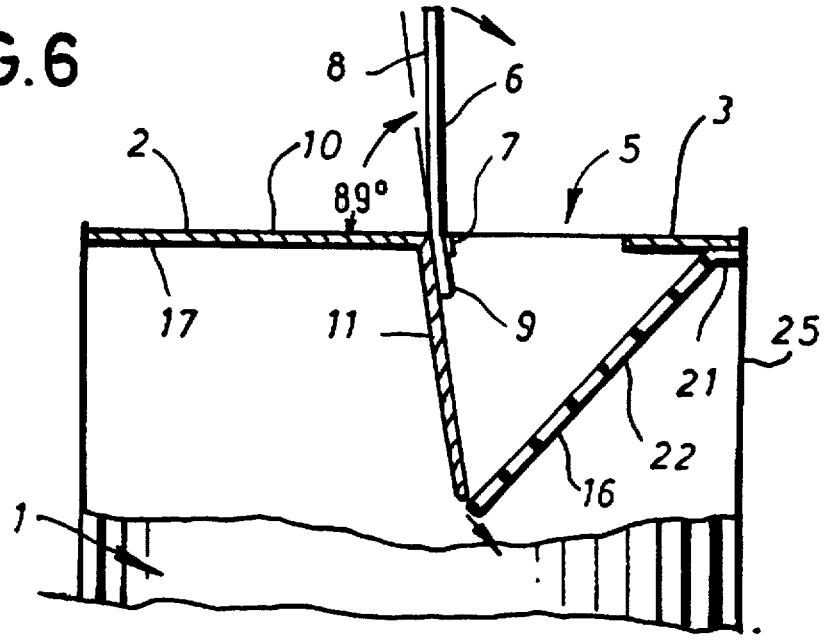

It has been found that using a relatively coarse sieve as the filter 22, carbonated drinks can be dispensed without significantly disrupting the pouring qualities of the beverage. It may however in some instances be desirable to dispense the contents of the container 1 while bypassing the filter 22. This can be achieved by interrupting the actuating motion of the tab 6 at the intermediate position as shown in FIGS. 5 or 6 at which the dispensing aperture 5 is adequately defined for the purpose of dispensing but at which the filter 22 is held at a stand off distance from the inner face 17. In this intermediate position, the contents can be poured without filtering action, this being perhaps preferable when it is desired to decant the contents into a receptacle before drinking. If the liquid contents are only partially decanted, the tab 6 may then be fully actuated to allow the filter 22 to reach its deployed position to thereby protect the remaining contents from contamination prior to further pouring.

The adhesive utilized for bonding the mounting portion 21 to the plate 3 is selected to have non-toxic properties. Adhesives such as those utilized in dentistry for example would be suitable.

Alternatively, ultrasonic welding techniques may be utilized. In this instance it may be necessary to add a layer of a plastics material to the inner face 17 of the plate 3.

Where adhesive is utilized, a single spot of adhesive may be sufficient or alternatively a crescent-shaped area of adhesive extending peripherally of the groove 4 may be utilized.

An alternative container will now be described with reference to FIGS. 9 and 10 using corresponding references to those of preceding Figures where appropriate for corresponding elements.

Figure 9:
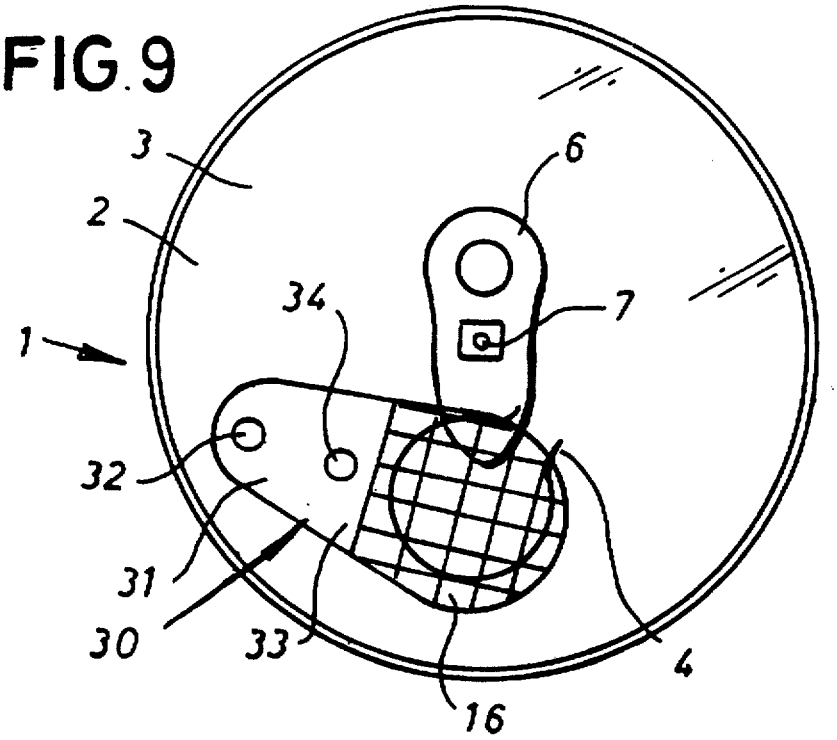
FIG. 9 is a schematic plan view of an alternative container in which a plan view of the filtering means is superimposed to indicate its position relative to the tear line and the tab.

In FIG. 9 a container 1 has a top 2 comprising a plate 3 in which a groove 4 provides a zone of weakness for the formation of a dispensing aperture as described above with reference to FIG. 1.

A filtering means 30 is mounted within the container and, although hidden from view before opening the container, is shown schematically superimposed on the plan view of the plate 3 in order to illustrate the location of the filtering means.

The filtering means 30 comprises a mounting portion 31 formed of resilient metal sheet which is secured at one end to the inner face 17 of the plate 3 by means of a rivet 32. The rivet 32 is formed integrally with the material of the plate 3, being constituted by a downwardly extending projection which extends through a connecting aperture in the mounting portion 31, the rivet thereafter being flattened by a suitable tool during the assembly process.

Figure 10:
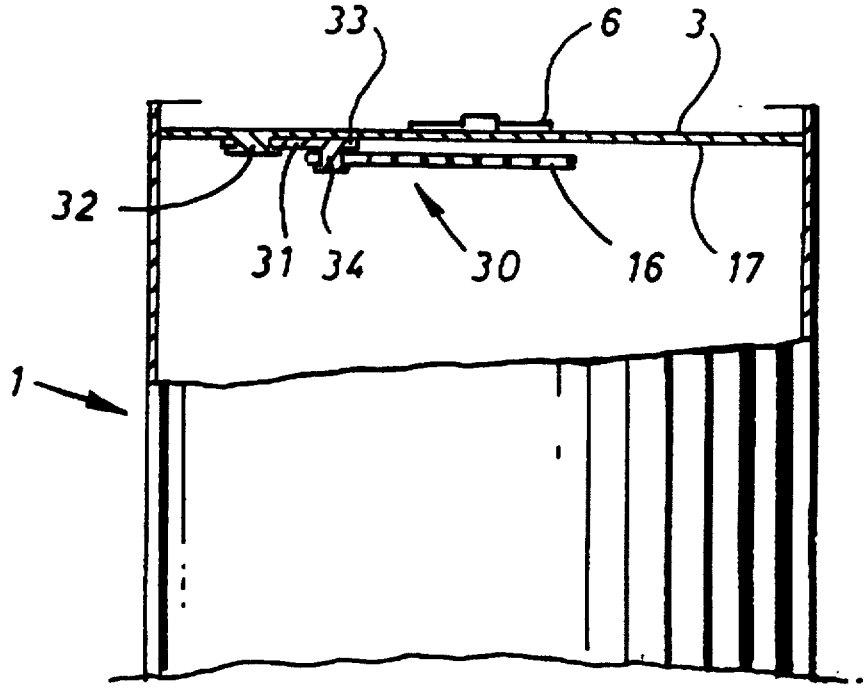
FIG. 10 is a schematic sectional side elevation of the container of FIG. 9.

A free end portion 33 of the metal sheet is resiliently bendable away from the inner face 17 and has a shape memory retaining the free end portion in contact with the inner face as shown in FIG. 10.

The free end portion 33 is connected to a filter 16 by a further rivet 34 formed integrally with the free end portion 33 as a projection extending through a connecting aperture in the filter. The filter 16 is thereby held in an initial position adjacent to the inner face 17.

During opening of the container 1, the filter 16 is moveable in a similar manner to that described above with reference to FIGS. 4 to 8, the resilience of the free end portion 33 acting as a biasing means returning the filter to its deployed position after formation of the aperture.

Figure 11:
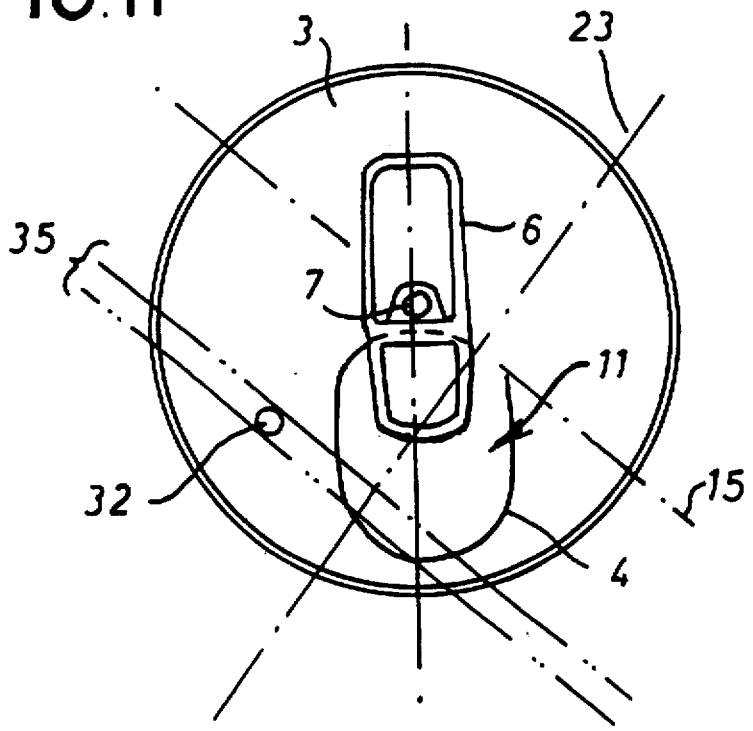
FIG. 11 is a schematic plan view of the container of FIGS. 9 and 10 indicating the location of a connecting formation between the plate and the filtering means.

The location of the rivet 32 is further illustrated in FIG. 11 in which datum lines 35 indicate generally the location of the point of attachment between the mounting portion 31 and the plate 3. A further datum line 23 indicates the bend line about which the filtering means 30 bends in response to movement of the tongue portion 11, the filtering means 30 being mounted such that this bend line is orthogonal to the bend line 15 of the tongue portion 11. The rivet 32 may alternatively be located at any other position on the inner face which may be appropriate for adequate deployment of the filtering means 30.

The filter 22 of the container of FIGS. 9 and 10 may alternatively be formed of metal, thereby enabling the metallic materials of the mounting portion 31 and the filter 22 to be selected according to their required properties of resilience and suitability for filtering respectively.

Figure 12:
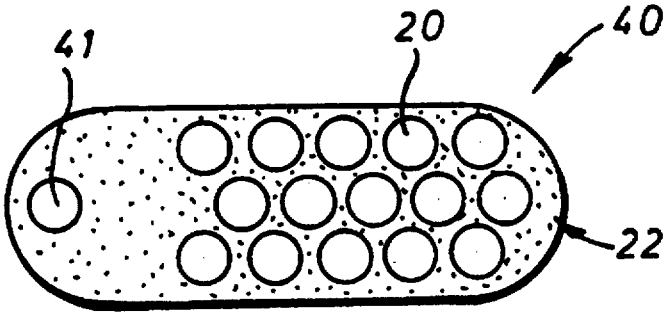
FIG. 12 is a plan view of an alternative filtering means.

Alternatively, a filtering means 40 may be of unitary construction as shown in FIG. 12 and formed of a single metallic material. The filtering means 40 is formed as an elongate strip of the same metallic material as the plate 3 of the container 1, a connecting aperture 41 being provided at one end for receiving rivet 32 and a series of filter apertures 20 being provided at the other end to define the filter 22. The use of a common material for the filtering means 40 and the plate 3 has the advantage of simplifying recycling of the container 1. A further advantage is that the filtering means 40 can be secured to the plate using connecting formations of the same type as those used to connect the tab 6 to the upper surface of the plate 3, thereby simplifying the assembly process by using common techniques.

Figure 13:
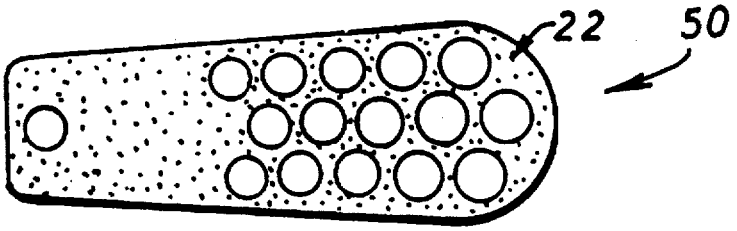
FIG. 13 is a plan view of a further alternative filtering means.
Figure 14:
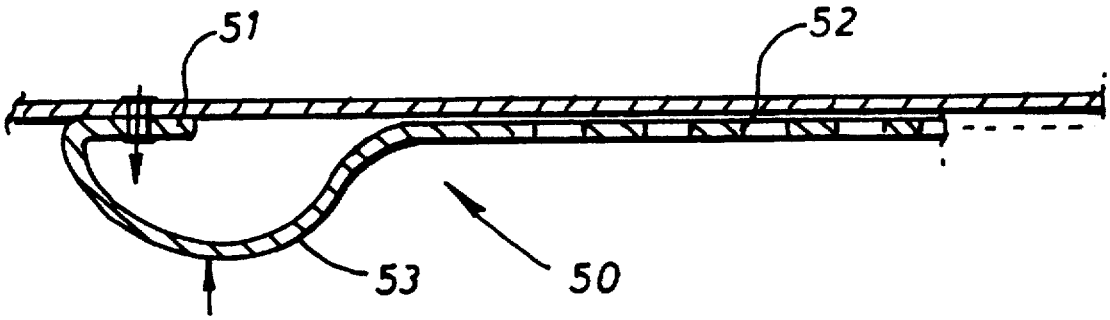
FIG. 14 is a schematic side elevation of the filtering means of FIG. 13 and having a bowed portion.

A further alternative filtering means 50 is shown in FIG. 13 and 14. The filtering means 50 comprises a single elongate strip of metallic material in sheet form having a first flat portion 51 constituting a mounting portion, a second flat portion 52 which is perforate to define a series of filter apertures 20, and a bowed portion 53 intermediate the first and second flat portions having a shape memory tending to retain the first and second flat portions in co-planar relationship. The bowed portion 53 thereby provides biasing means for returning the filter 22 constituted by the second flat portion 52 to a deployed position as shown in FIG. 14.

For compactness, the first flat portion 51 is formed by being bent through an obtuse angle relative to the bowed portion 53 so that the bowed portion overlays the first flat portion in spaced relationship thereto.

Figure 15:
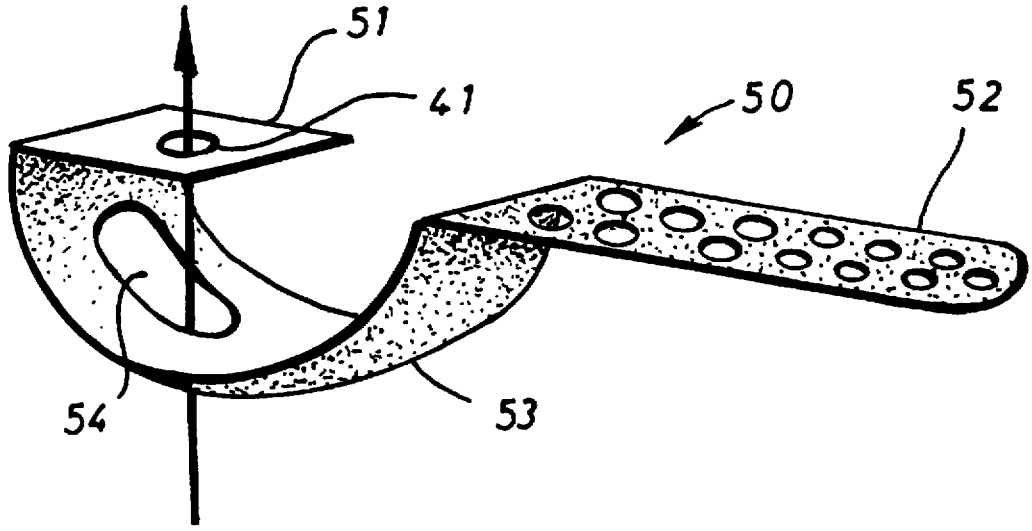
FIG. 15 is a perspective view of a modified version of the filtering means of FIGS. 13 and 14.

In order to gain access during assembly to a rivet 32 extending through a connecting aperture 41 formed in the first flat portion 51, an access aperture 54 may be provided in the bowed portion 53 as shown in the alternative configuration of FIG. 15.

The filtering means 40, 50 of FIGS. 13 to 15 are particularly useful when using a material such as aluminium which exhibits relatively poor resilience, the effect of the bowed portion being to longitudinally distribute bending of the material in order to avoid the onset of plastic deformation.

A further alternative will now be described using corresponding reference numerals to those of preceding Figures where appropriate for corresponding elements. FIGS. 16 to 22 illustrate a further alternative filtering means 60 in the form of an elongate strip of metallic material, selected to be the same material as that constituting the plate 3 and the body 25 of the container 1. Typically this material is aluminium, thereby enabling the entire container including the filtering means 60 to be recyclable.

Figure 16:
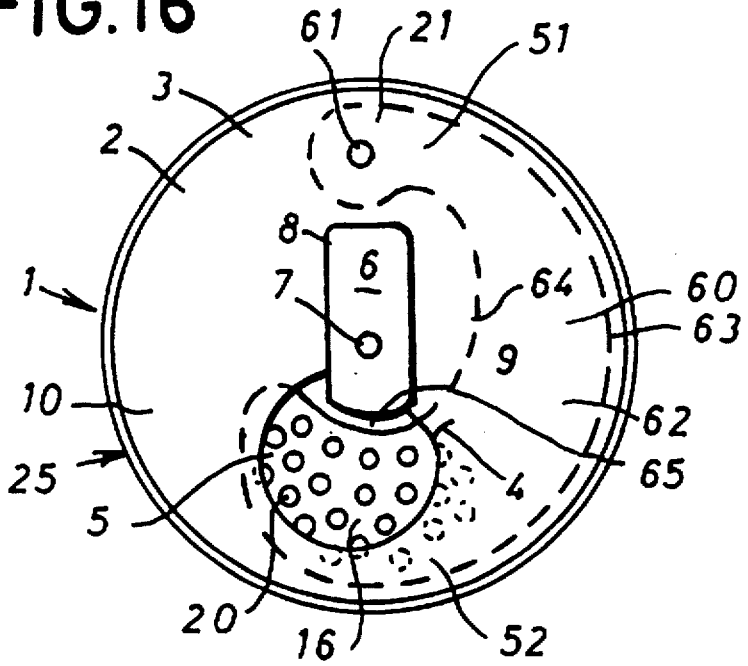
FIG. 16 is a plan view of a container having a further alternative filtering means.

In the plan view of FIG. 16, the outline of the filtering means 60 is indicated in broken lines, except where revealed via the dispensing aperture 5, the container 1 being illustrated in FIG. 1 6 after completion of an actuating cycle in which the dispensing aperture 5 is fully opened and the tab 6 returned to its initial position.

Figure 17:
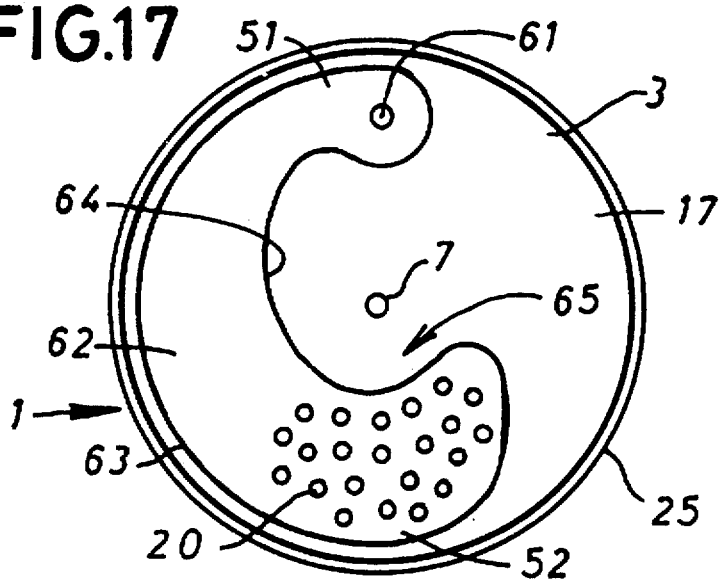
FIG. 17 is an underneath view of the top plate of the container of FIG. 16.

As seen in underneath view in FIG. 17 before actuation, the filtering means 60 extends as a flat strip in contact with the underside of the plate 3 and, when viewed orthogonally to the plane of the strip, is seen to have an arcuate outline so as to extend curvilinearly between a first flat portion 51 fixedly mounted to the plate by means of a rivet formation 61 and a second flat portion 52 which is perforated to provide a number of filter apertures 20 enabling the second flat portion to serve as a filter. An intermediate portion 62 of flat strip has an outer edge 63 extending in proximity to the circumference of the plate 3 and an inner edge 64 which is curved to define a cut out 65 which underlays the location of the nose 9 of the tab 6. The cut out 65 also provides clearance beneath the rivet formation 7 to allow access for a tool during assembly.

The filtering means 60 is secured to the underside of the plate 3 in a process in which a hole provided in the first flat portion 51 receives a projection formed integrally with the plate 3, the projection then being flattened in a press so as to fixedly retain the first flat portion to serve as a mounting portion of the filtering means.

Figure 18:
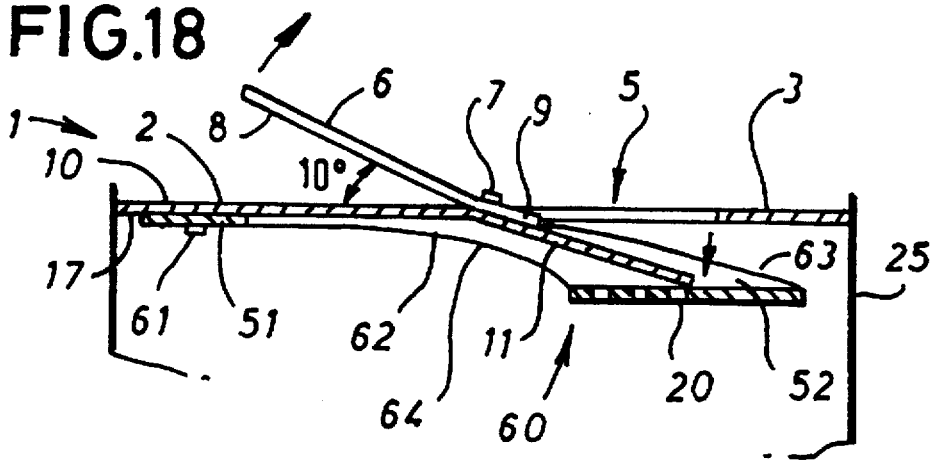
FIG. 18 is a partly sectioned elevation showing schematically the initial stage of opening of the container of FIGS. 16 and 17.

As shown in FIG. 18, actuation of the tab 6 in order to open the container 1 is effected by raising the tab such that it pivots about rivet formation 7 to downwardly force the nose 9, thereby resulting in tearing of the plate 3. The tongue 11 begins to become partially detached from the plate 3 and moves downwardly as a tear rapidly progresses around a tear line defined by groove 4 as described above.

Figure 19:
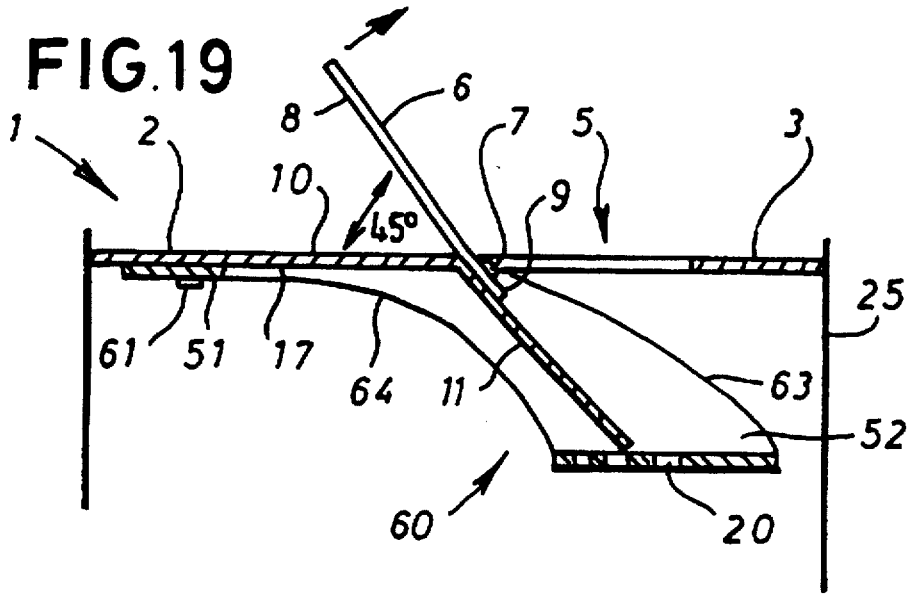

Downward motion of the tongue 11 displaces the second flat portion 52 out of contact with the plate 3 by resilient deformation of the intermediate portion 62. Further r actuation of the tab 6 is accompanied by further movement of the tongue 11 and further resilient deformation of the filtering means 60 as shown in FIG. 19 where the filtering means is held in an intermediate position in which it is held clear of the dispensing aperture.

Figure 20:
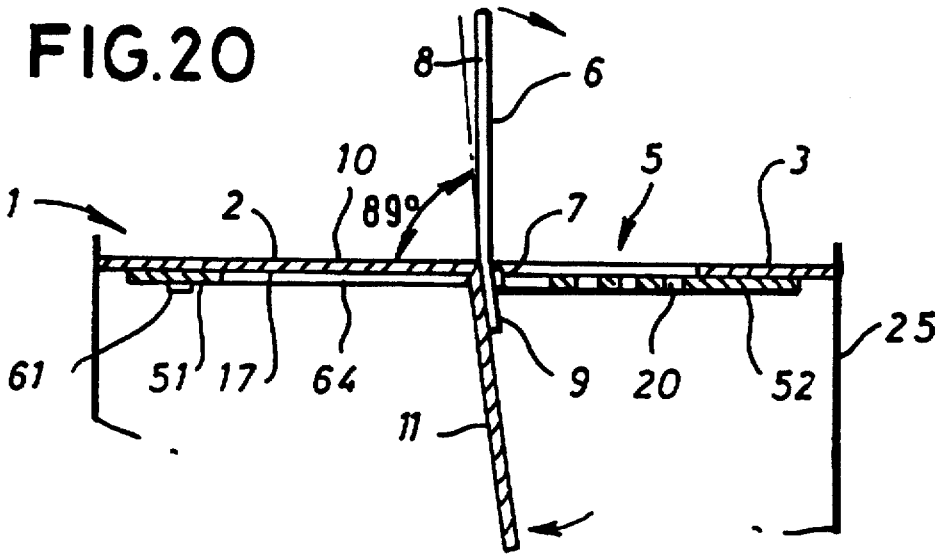

As shown in Figure 20, further motion of the tab and tongue releases the filtering means which then relaxes due to the shape memory of the intermediate portion 62 into the deployed position in which it extends in contact with the plate 3 and traverses the dispensing aperture 5.

Further motion of the tab continues as shown in FIG. 21, followed by reverse motion of the tab in to the configuration shown in FIG. 22 in which the tongue 11 remains in its deformed position leaving the dispensing aperture 5 unimpeded by the tongue for the subsequent dispensing of the contents of the container 1. In this final position, a filter 22 constituted by the second flat portion 52 and the apertures 20 provides filtering action to prevent the ingress of contaminants and the egress of any solids within the container 1. The provision of the cut out 65 allows the nose 9 to return to its rest position as shown in FIG. 2, the inner edge 64 being configured to provide a small clearance 66 relative to the nose, the clearance having a size comparable with the aperture size of the filter 22.

The disposition of the apertures 20 in the filtering means 60 is a regular array of circular holes. This pattern of holes or perforations may be varied in order to provide a means of identifying a selected container, or each one of a set of containers from a larger set of containers, if it is required to provide a visual indication means which becomes visible only after opening the container such that the visual indication means is visible via the dispensing aperture 5. A further alternative filtering means 70 as shown in FIG. 23 has apertures 71 which are disposed in a different pattern which is readily distinguishable from that of the filtering means 60 as seen in FIG. 16. The filtering means 70 has elongate apertures 71 arranged in a pattern such that they appear to radiate from a central location.

The visual pattern defined by the apertures 71 may be utilized for example in a competition in which an exposed portion 72, as viewed by the dispensing aperture 5, of the second flat portion 52 constitutes a visual indication means. In an example, a batch of containers are formed with visible indicating means of the type illustrated in FIG. 16 as comprising a regular array of circular apertures 20 and a single container as shown in FIG. 23 is provided with a different visible exposed portion 72 serving as a token indicating that a purchaser of the container is a winner of the competition.

Alternative forms of visual indication means include the application of colouring to the visual indication means 72 or any suitable form of visible marking, surface finish, pictorial representation, hologram or writing, whether alphanumerical or otherwise.

The visible indicating means may alternatively be constituted by a member resiliently biased into the deployed position but which does not provide any filtering means, solely for the purpose of providing visible indicia which are concealed prior to opening the container and which are subsequently visible via the dispensing aperture.

The embodiments of FIGS. 16 to 23 may be assembled entirely from aluminium components and in a process which the plate is connected to both the tab and to the filtering means in a single stamping or crimping operation in which the rivet formation 7 and the rivet formation 61 are deformed simultaneously. The sub-assembly comprising the plate, tab 6 and filtering means 60 or 70 may then be subsequently assembled with the body 25 of the container 1. Although forming all components of the container in this way from a single material such as aluminium is advantageous from the point of view of recycling, alternative embodiments are envisaged in which for example the filtering means is formed of steel sheet or plastics materials such as polypropylene.

Alternative embodiments are envisaged which encompass the use of plastics or metal materials either unitarily or in various combinations to form a filtering means and/or visible indicating means which may be either generally planar or include a bow or twist to achieve enhanced resilience. Various means of attachment are envisaged including adhesive or mechanical connecting formations, ultrasonic bonding or other forms of attachment and are considered to fall within the scope of the present invention.

The filtering means may have alternative configurations such as for example a generally circular member extending fully across the inner face of the plate and secured either to the plate or to the inner wall of the body of the container. Such a filtering means may for example include a partially cut out flap corresponding in shape to the filter of the above described preferred embodiment and which is resiliently deformable so as to be biased into the deployed position. Alternative arrangements are envisaged in which a separate biasing means such as a spring is utilized to resiliently bias the filter into the deployed position. The biasing member may be a leaf spring or other form of spring and may be mounted on the plate or container body.

The filter means and/or visible indicating means of the present invention may also be used in containers having ring pull tab opening devices in which the tongue is removed and discarded.

We claim:

1. A container having a top comprising a top plate with an inner and outer face, said top plate is disruptable at a zone of weakness constituted by a tear line defining in outline a tongue portion, the top further comprising actuating means mounted on the outer face of the top plate and operable to cause tearing of the top plate along the tear line and to inwardly displace the tongue portion relative to the top plate to define a dispensing aperture; and filtering means mounted internally of the container and comprising a filter and mounting means to support the filter at a deployed position adjacent to the top plate at a location traversing the dispensing aperture, said filter being displaceable to an intermediate position at which it is spaced from the inner face of the top plate to accommodate inward movement of the tongue portion and being displaceable thereafter to the deployed position.

2. A container as claimed in claim 1, wherein the mounting means is fixedly mounted to the top plate and supporting the filter so as to be deflectable relative to the mounting means, and biasing means operable to bias the filter into contact with the top plate in the deployed position.

3. A container as claimed in claim 2, wherein the filter is comprised of a resilient filter member of unitary construction having a shape memory tending to bias the filter into contact with the inner face of the top plate.

4. A container as claimed in claim 3 wherein the mounting means is adhesively mounted to the inner face of the top plate.

5. A container as claimed in claim 2 wherein the mounting means is mounted to the top plate by means of co-operating connecting formations.

6. A container as claimed in claim 5 wherein the connecting formations comprise a projection formed integrally with the top plate and received in a connecting aperture defined in the mounting means.

7. A container as claimed in claim 2 wherein the filter and the mounting means are formed of the same material as the top plate.

8. A container as claimed in claim 7 wherein the filter and the mounting means are formed of aluminium.

9. A container as claimed in claim 2, wherein the filtering means comprises an elongate strip in sheet form having a first flat portion comprising the mounting means, a perforate second flat portion comprising the filter and an intermediate portion intermediate the first and second flat portions comprising the biasing means.

10. A container as claimed in claim 9 wherein the intermediate portion comprises a bowed portion which overlays the mounting means in spaced relationship thereto and wherein the bowed portion defines an access aperture for facilitating access to the mounting means during assembly.

11. A container as claimed in claim 9 wherein the intermediate portion also comprises a third flat portion of the elongate strip which in the deployed position is co-planar with the first and second flat portions.

12. A container as claimed in claim 11 wherein the elongate strip is arcuate in profile when viewed in projection orthogonally to the first flat portion so as to define a cut out accommodating inward and outward movement of the actuating means relative to the top plate.

13. A container as claimed in claim 1 wherein the tear line is discontinuous to thereby define a first bend line about which the tongue portion is inwardly pivoted when the actuating means is actuated and wherein the filter is deflectable about a second bend line formed substantially at right angles to the first bend line.

14. A container as claimed in claim 13, wherein the actuating means has a fulcrum at which the first and second bend lines intersect.

15. A container as claimed in claim 1 wherein the filter comprises a sieve of plastic material.

16. A container as claimed in claim 15 wherein the sieve has a hole size in the range 2 to 5 mm.

17. A container as claimed in claim 15, wherein the sieve comprises a grid of a first set of mutually parallel linear members and a second set of mutually parallel members said first set being intersected by said second set.

18. A container as claimed in claim 1 comprising a beverage can.

19. A sub-assembly for incorporation into a container, the sub-assembly comprising a top having a top plate with an inner face and an outer face, said top plate being disruptable at a zone of weakness comprised of tear line defining in outline a tongue portion, said top further comprising actuating means mounted on the outer face of the top plate and operable to cause tearing of the plate along the tear line and to displace the tongue portion relative to the top plate to define a dispensing aperture; and filtering means mounted on the inner face of the top plate comprising a filter and mounting means to support the filter at a deployed position adjacent to the top plate at a location traversing the dispensing aperture.

20. A filtering means for connection to the inner face of a top plate of a container, the filtering means comprising an elongate strip in sheet form having a first flat portion for mounting the filtering means to the inner face of the top plate, a perforate second flat portion comprising a filter, and an intermediate portion intermediate the first and second portions, wherein the intermediate portion is resilient and has a shape memory whereby the second flat portion is biased into contact with the inner face of the top plate in the deployed position.

21. A container having a top comprising a top plate, having an outer face and inner face, said top plate being disruptable at a zone of weakness comprised of a tear line defining in outline a tongue portion, the top further comprising actuating means mounted on the outer face of the top plate and operable to cause tearing of the top plate along the tear line and to displace the tongue portion relative to the plate to define a dispensing aperture; and a visual indication structure mounted internally of the container by mounting means operable to support the visual indication structure at a deployed position adjacent to the top plate at a location traversing the dispensing aperture, said visual indication structure being capable of serving as a token in competition.

22. A container as claimed in claim 21, wherein the visual indication structure which constitutes a pattern which is provided by an arrangement of perforations therein.

23. A method of dispensing liquid from a container comprising the steps of:

operating an actuating means to disrupt a top plate, having an inner face and outer face; in the top of a container by tearing of the top plate along a pre-formed tear line and inwardly displacing a tongue portion defined in outline by the tear line to form a dispensing aperture;

deflecting a filter mounted in an initial position adjacent the inner face of the top plate to an intermediate position at which it is spaced from the inner face by displacement of the tongue portion;

further displacing the tongue portion to a position in which the filter is free to relax to a deployed position in which it extends adjacent to the inner face of the top plate to thereby traverse the dispensing aperture;

and dispensing liquid via the dispensing aperture.

24. A method as claimed in claim 23 including the step of displaying a visual pattern in the filter so as to be concealed prior to operating the actuating means and to be subsequently revealed and visible via the dispensing aperture after the filter relaxes to the deployed position, said visual pattern being capable of serving as token for competition.

25. A method as claimed in claims 23 including the step of arresting movement of the actuating means at a location such that the filter is held by the tongue portion at the intermediate position so as to be held clear of the inner face by the tongue portion;

and dispensing liquid via the dispensing aperture.

26. A method of dispensing liquid from a container comprising the steps of:

operating an actuating means to disrupt a top plate, having an outer face and an inner face, in the top of a container by tearing of the top plate along a pre-formed tear line and displacing a tongue portion defined in outline by the tear line to form a dispensing aperture;

deflecting a visual indication means mounted by mounting means in an initial position adjacent an inner face of the top plate to an intermediate position at which it is spaced from the inner face by displacement of the tongue portion;

further displacing the tongue portion to a position in which the visual indication means is free to relax to a deployed position in which it extends adjacent to the inner face of the top plate to thereby traverse the dispensing aperture, thereby revealing the visible indication means so as to be visible via the dispensing aperture; and dispensing liquid via the dispensing aperture.

* * * * *

US005775534C1

(12) REEXAMINATION CERTIFICATE (4242nd)

United States Patent

Webb et al.

(10) Number: US 5,775,534 C1

(45) Certificate Issued: Jan. 2, 2001

(54) BEVERAGE CONTAINER HAVING FILTERED OPENING

(76) Inventors: Michael Reginald Webb, Theydon Willows, Copice Row, Theydon Bois, Essex CM16 7DP; Denis Matthews, Laurel House, Earlstone Common, Burghclere, Nr. Newbury, RG20 9HN, both of (GB)

Reexamination Request:
No. 90/005,443, Aug. 4, 1999

Reexamination Certificate for:

| | |
|---|---|
| Patent No.: | **5,775,534** |
| Issued: | **Jul. 7, 1998** |
| Appl. No.: | **08/601,341** |
| Filed: | **Feb. 16, 1996** |

(30) Foreign Application Priority Data

| | | |
|---|---|---|
| Nov. 24, 1995 | (GB) | 9524099 |
| Jan. 12, 1996 | (GB) | 9600640 |
| Feb. 5, 1996 | (GB) | 9602263 |

(51) Int. Cl.[7] ..... B65D 17/34

(52) U.S. Cl. ..... 220/269; 220/266; 220/270; 220/360; 220/372; 220/730; 220/906; 222/1; 222/189.07

(58) Field of Search ..... 220/269, 270, 220/906, 730, 266, 372; 222/1, 189.07

(56) References Cited

FOREIGN PATENT DOCUMENTS

| | | |
|---|---|---|
| 40 22 408 A1 | 1/1992 | (DE) . |
| 40 38 329 A1 | 6/1992 | (DE) . |

*Primary Examiner*—R Hylton

(57) ABSTRACT

A beverage container in the form of an aluminium can has a top plate in which a dispensing aperture is formed by pulling a tab so as to inwardly displace a tongue portion. A filtering means is resiliently mounted within the container so as to be deployed at a location traversing the dispensing aperture after the tongue portion has been inwardly displaced. The filtering means may be a perforate plate and may have perforations defining a competition visual indication whereby the token becomes visible only after the container is opened.

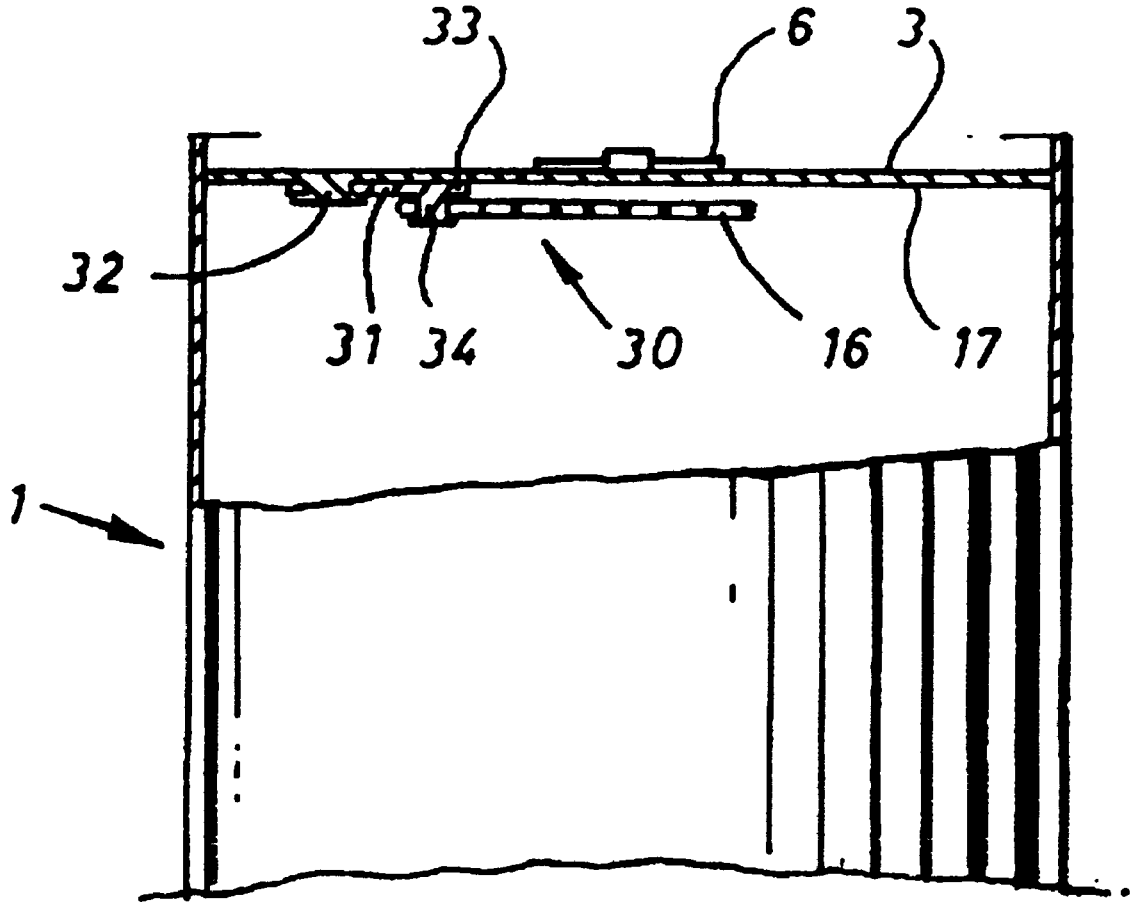

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 3, 9, 11, 12 and 20–26 are cancelled.

Claims 1, 4–8, 10 and 19 are determined to be patentable as amended.

Claims 13–18, dependent on an amended claim, are determined to be patentable.

New claim 27 is added and determined to be patentable.

1. A container having a top comprising a top plate with an inner and outer face, said top plate [is] *being* disruptable at a zone of weakness constituted by a tear line defining in outline a tongue portion, the top further comprising actuating means mounted on the outer face of the top plate and operable to cause tearing of the top plate along the tear line and to inwardly displace the tongue portion relative to the top plate to define a dispensing aperture; and filtering means mounted internally of the container and comprising a filter and mounting means to support the filter at a deployed position adjacent to the top plate at a location traversing the dispensing aperture, said filter being displaceable to an intermediate position at which it is spaced from the inner face of the top plate to accommodate inward movement of the tongue portion and being displaceable thereafter to the deployed position*;*

*said filtering means being formed as an elongate strip of material in sheet form;*

*said elongate strip comprising a first flat portion fixedly mounted to the top plate to constitute said mounting means, a perforate second flat portion constituting said filter and an intermediate portion intermediate the first and second flat portions;*

*said material having a shape memory tending to bias the perforate portion into contact with the inner face of the top plate in the deployed position;*

*and wherein the elongate strip is arcuate in profile when viewed in projection orthogonally to the first flat portion so as to define a cut out accommodating inward and outward movement of the actuating means relative to the top plate.*

4. A container as claimed in claim [3] *1* wherein the [mounting means] *first flat portion* is adhesively mounted to the inner face of the top plate.

5. A container as claimed in claim [2] *1* wherein the [mounting means] *first flat portion* is mounted to the top plate by means of co-operating connecting formations.

6. A container as claimed in claim 5 wherein the connecting formations comprise a projection formed integrally with the top plate and received in a connecting aperture defined in the [mounting means] *first flat portion*.

7. A container as claimed in claim [2] *1* wherein the [filter and the mounting means are] *elongate strip is* formed of the same material as the top plate.

8. A container as claimed in claim 7 wherein the [filter and the mounting means are] *elongate strip is* formed of aluminium.

10. A container [as claimed in claim 9] *having a top comprising a top plate with an inner and outer face, said top plate being disruptable at a zone of weakness constituted by a tear line defining in outline a tongue portion, the top further comprising actuating means mounted on the outer face of the top plate along the tear line and operable to cause tearing of the top plate along the tear line and to inwardly displace the tongue portion relative to the top plate to define a dispensing aperture; and filtering means mounted internally of the container and comprising a filter, mounting means fixedly mounted to the top plate to support the filter at a deployed position adjacent to the top plate at a location traversing the dispensing aperture, and biassing means operable to bias the filter into contact with the top plate in the deployed position; said filter being displaceable to an intermediate position at which it is spaced from the inner face of the top plate to accommodate inward movement of the tongue portion and being displaceable thereafter to the deployed position;*

*wherein the filtering means comprises an elongate strip in sheet form having a first flat portion comprising the mounting means, a perforate second flat portion comprising the filter and an intermediate portion intermediate the first and second flat portions comprising the biassing means;* wherein the intermediate portion comprises a bowed portion which overlays the mounting means in spaced relationship thereto and wherein the bowed portion defines an access aperture for facilitating access to the mounting means during assembly.

19. A sub-assembly for incorporation into a container, the sub-assembly comprising a top having a top plate with an inner face and an outer face, said top plate being disruptable at a zone of weakness comprised of *a* tear line defining in outline a tongue portion, said top further comprising actuating means mounted on the outer face of the top plate and operable to cause tearing of the plate along the tear line and to displace the tongue portion relative to the top plate to define a dispensing aperture; and filtering means mounted on the inner face of the top plate comprising a filter and mounting means to support the filter at a deployed position adjacent to the top plate at a location traversing the dispensing aperture*;*

*said filtering means being formed as an elongate strip of material in sheet form;*

*said elongate strip comprising a first flat portion fixedly mounted to the top plate to constitute said mounting means, a perforate second flat portion constituting said filter and an intermediate portion intermediate the first and second flat portions;*

*said material having a shape memory tending to bias the perforate portion into contact with the inner face of the top plate in the deployed position;*

*and wherein the elongate strip is arcuate in profile when viewed in projection orthogonally to the first flat portion so as to define a cut out accommodating inward and outward movement of the actuating means relative to the top plate.*

*27. A container having a top comprising a top plate with an inner and outer face, said top plate being disruptable at a zone of weakness constituted by a tear line defining in outline a tongue portion, the top further comprising actuating means mounted on the outer face of the top plate along*

*the tear line and operable to cause tearing of the top plate along the tear line and to inwardly displace the tongue portion relative to the top plate to define a dispensing aperture; and filtering means mounted internally of the container and comprising a filter and mounting means to support the filter at a deployed position adjacent to the top plate at a location traversing the dispensing aperture, said filter being displaceable to an intermediate position at which it is spaced from the inner face of the top plate to accommodate inward movement of the tongue portion and being displaceable thereafter to the deployed position;*

*said filtering means being formed as an elongate strip of material in sheet form;*

*said elongate strip comprising a first flat portion fixedly mounted to the top plate to constitute said mounting means, a perforate second flat portion constituting said filter and an intermediate portion intermediate the first and second flat portions;*

*said material having a shape memory tending to bias the perforate portion into contact with the inner face of the top plate in the deployed position;*

*and wherein the elongate strip, viewed in projection orthogonally to the first flat portion, defines a cut out accommodating inward and outward movement of the actuating means relative to the top plate.*

* * * * *